US007677553B2

(12) United States Patent
Ikeda

(10) Patent No.: US 7,677,553 B2
(45) Date of Patent: Mar. 16, 2010

(54) SHEET FEEDING APPARATUS AND IMAGE FORMING APPARATUS

(75) Inventor: Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 433 days.

(21) Appl. No.: 11/509,009

(22) Filed: Aug. 24, 2006

(65) Prior Publication Data

US 2007/0194514 A1 Aug. 23, 2007

(30) Foreign Application Priority Data

Feb. 21, 2006 (JP) ..... 2006-044502

(51) Int. Cl.
*B65H 3/14* (2006.01)

(52) U.S. Cl. ..... 271/98; 271/97

(58) Field of Classification Search ..... 271/97, 271/98, 104, 105

See application file for complete search history.

(56) References Cited

U.S. PATENT DOCUMENTS

| | | | | |
|---|---|---|---|---|
| 5,110,110 | A * | 5/1992 | Wirz et al. | 271/98 |
| 5,150,892 | A * | 9/1992 | Shimizu | 271/98 |
| 5,645,274 | A | 7/1997 | Ubayashi et al. | 271/94 |
| 5,836,582 | A * | 11/1998 | Ogawa et al. | 271/12 |
| 5,876,030 | A * | 3/1999 | Dobbertin et al. | 271/13 |
| 6,431,538 | B1 * | 8/2002 | La Vos et al. | 271/98 |
| 6,729,614 | B2 * | 5/2004 | Okazaki et al. | 271/97 |
| 2006/0017209 | A1 | 1/2006 | Kushida et al. | 270/37 |
| 2006/0017218 | A1 | 1/2006 | Kawata et al. | 271/207 |
| 2006/0019811 | A1 | 1/2006 | Ikeda et al. | 493/444 |
| 2006/0288893 | A1 | 12/2006 | Ikeda | 101/407.1 |

FOREIGN PATENT DOCUMENTS

| | | |
|---|---|---|
| EP | 1 090 859 | 4/2001 |
| JP | 4-23747 | 1/1992 |
| JP | 7-196187 | 8/1995 |
| JP | 10-35927 | 2/1998 |
| JP | 2002-2986 | 1/2002 |
| JP | 2002-104679 | 4/2002 |

* cited by examiner

*Primary Examiner*—Patrick H Mackey
*Assistant Examiner*—Ernesto Suarez
(74) *Attorney, Agent, or Firm*—Fitzpatrick, Cella, Harper & Scinto

(57) ABSTRACT

An air blowing portion blows air toward an edge surface on a downstream side in a sheet feeding direction of a sheet. A presser portion presses an upper surface of the sheet at both side edge portions in a width direction of the sheet, thereby allowing, throughout an entire region of the sheets in a sheet feeding direction, a central portion in a width direction perpendicular to the sheet feeding direction of the sheet to blow up with the air blown by the air blowing portion.

10 Claims, 13 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more particularly, to a mechanism for loosening a sheet stack by blowing air on an edge portion of the sheet stack.

2. Description of the Related Art

Of conventional image forming apparatuses such as copying machines and printers, there is provided an image forming apparatuses including a sheet feeding apparatus for feeding sheets one by one, starting from an uppermost sheet of the stacked sheets, toward an image forming portion while separating the sheets stacked on a sheet stacking portion.

As disclosed in Japanese Patent Application Laid-Open No. H07-196187 (U.S. Pat. No. 5,645,274), for such the sheet feeding apparatus, there exists a system for feeding sheets by blowing air (gas) on an edge portion of a sheet stack on a sheet stacking portion to allow a plurality of sheets to float and allowing an uppermost sheet of the sheet stack to suck onto a suction conveyer belt.

FIG. 6 shows a structure of a sheet feeding apparatus for feeding sheets by allowing the sheets to float using air and allowing an uppermost sheet of the floating sheets to suck onto a suction conveyer belt.

In FIG. 6, a storage 11 is provided to an image forming apparatus main body (not shown) so as to be drawable and stores a sheet S. The storage 11 is provided with a sheet tray 12 on which a plurality of sheets S are stacked and capable of moving up and down, and a trailing edge regulating plate 13 for regulating a position of a sheet trailing edge which is an edge portion on an upstream side (rear side) in a sheet feeding direction of a sheet stack SA. Further, the storage 11 is provided with side edge regulating plates 14 and 16 for regulating positions of side edges, which are edge portions in a width direction perpendicular to the sheet feeding direction of the stacked sheet S. Further, the image forming apparatus main body (not shown) is provided with slide rails 15 for drawing the storage 11.

A suction conveyer belt 21 sucks and feeds the uppermost sheet of the floating sheets, and a suction fan 36 creates a negative pressure for allowing the sheet S to suck onto the suction conveyer belt 21. An air blowing portion 30 blows air on a sheet leading edge, which is an edge portion on a downstream side (i.e., front side) in the sheet feeding direction of the sheet stack SA. The air blowing portion 30 includes a separation fan 31, a separation duct 32, a loosening nozzle 33, and a separation nozzle 34.

Here, the trailing edge regulating plate 13 can move in a direction indicated by an arrow R and the side edge regulating plates 14 and 16 can move in a direction indicated by the arrows Q shown in FIG. 7 according to a size of a sheet stacked on the sheet tray 12. In FIG. 7, a chain double-dashed line indicates a position of a sheet SL of a maximum size and a long dashed dotted line indicates a position of a sheet SS of a minimum size when the sheet SL and the sheet SS are stacked on the sheet tray 12, respectively.

Note that, the side edge regulating plates 14 and 16 need to retain sheets ranging from the sheet SS of the minimum size to the sheet SL of the maximum size in a stable manner, so the side edge regulating plates 14 and 16 are provided in a state where the plates are divided into a plurality of pieces in the sheet feeding direction. The sheet tray 12 is partially cut away in portions in which the side edge regulating plates 14 and 16 move to thereby the sheet tray 12 assumes a shape of a hatched region of FIG. 7.

Here, in the sheet feeding apparatus having the above-mentioned structure, in a case where a user draws out the storage 11 from the image forming apparatus main body to set the sheet S therein and then stores the storage 11, the sheet tray 12 moves up in a direction indicated by the arrow A shown in FIG. 8 by drive means (not shown). The sheet tray 12 stops and waits at a position, where a distance between an upper surface of the sheet stack SA and a suction surface of the suction conveyer belt 21 corresponds to a dimension B, while being ready for a sheet feeding signal.

Next, when the feeding signal is input, the separation fan 31 operates to suck air in a direction indicated by the arrows C of FIG. 9. The air sucked by the separation fan 31 passes through the separation duct 32 and is blown from the loosening nozzle 33 and the separation nozzle 34 in directions indicated by the arrows D and E, respectively, toward a leading edge portion of the sheet stack SA. The air blown from the loosening nozzle 33 allows several sheets Sa on an upper portion of the sheet stack SA to float, and the air blown from the separation nozzle 34 separates a sheet next to an uppermost sheet Sb from the sheet Sb adhering onto the suction conveyer belt 21. Meanwhile, the suction fan 36 operates to discharge the air from a suction duct 38 in a direction indicated by the arrows F of FIG. 9. At this time, a suction shutter 37 provided in the suction duct 38 is closed.

Note that, the side edge regulating plates 14 and 16 are provided with auxiliary separation fans 17 and 18, respectively. The auxiliary separation fans 17 and 18 blow air on a side edge portion of the sheet stack SA from openings 14A and 16A, respectively. The auxiliary separation fans 17 and 18 are thus provided, thereby allowing the several upper sheets Sa to reliably float. Examples of a document describing such the structure include Japanese Patent Application Laid-Open No. 2003-182873.

Next, when the several upper sheets Sa stably float after a predetermined period of time has passed since the feeding signal is input, the suction shutter 37 is rotated in a direction indicated by the arrows G of FIG. 10. As a result, a suction force is generated by the suction fan 36 in a direction indicated by the arrows H from suction holes (not shown) formed in the suction conveyer belt 21, thereby allowing the uppermost sheet Sb of the several upper sheets Sa, which are allowed to float, to be sucked by the suction conveyer belt 21.

By rotating belt drive rollers 41 in a direction indicated by the arrows J of FIG. 11, the sheet Sb being sucked by the suction conveyer belt 21 is fed in a direction indicated by the arrow K. After that, the sheet Sb is sent to a conveying path by a drawing roller pair 42 including rollers rotating in directions indicated by the arrows M and P, respectively.

In the conventional sheet feeding apparatus having a structure in which sheets can be fed in a separated state by blowing air on the sheet stack SA, in a case of using a sheet which has a low strength and is long in the sheet feeding direction, as shown in FIG. 12, a portion is generated in which the several upper sheets Sa are not allowed to float.

As shown in FIG. 12, in a region where the sheets are brought into contact with one of the side edge regulating plates 14 on the side of the air blowing portion 30 of the sheet stack SA, owing to a floating force generated by air from the air blowing portion 30 and air from the auxiliary separation fan 17, the sheets in the sheet stack SA is equally loosened.

However, in a portion between the region where the sheets are allowed to float by the auxiliary separation fan 17 and a region where the sheets are allowed to float by the auxiliary separation fan 18, there is generated a region 35B of FIG. 12 in which no sheet S is allowed to float at all. Further, on the trailing edge side of the region in which the sheet is allowed to float by the auxiliary separation fan 18, there is generated a region 35C of FIG. 12 where no sheet S is allowed to float at all.

Still further, as shown in FIG. 12, a difference shown as a dimension C is generated in a portion between a height to which the uppermost sheet is allowed to float in the region where the side edge regulating plate 14 on the right side in FIG. 12 comes into contact with the sheets and a height to which the uppermost sheet is allowed to float in the region where the side edge regulating plate 16 on the left side in FIG. 12 comes into contact with the sheets. This is because while in the region where the side edge regulating plate 14 on the right side comes into contact with the sheets, both the air blowing portion 30 and the auxiliary separation fan 17 impart the floating force to the sheets, in the region where the side edge regulating plate 16 on the left side comes into contact with the sheets, only auxiliary separation fan 18 imparts the floating force. In this case, the region where no sheet S is allowed to float is a region where the sheets adhere to each other. If such the region exists, in feeding the sheets by the suction conveyer belt 21, it is impossible to prevent generation of a double feed due to the adhesion of the sheets.

FIG. 13 is a top view showing flows of air at this time. In FIG. 13, a hatched portion indicates an example of a portion where adhesion of the sheets is not eliminated. That is, the hatched portion corresponds to a portion where the sheets are adhered to each other. Further, in FIG. 13, portions indicated by circles are portions where air leaks laterally to outside. When air leaks laterally to the outside as shown in FIG. 13, air to be blown passes the sheets without allowing the sheets to float, so the sheets cannot be sufficiently loosened.

In particular, when the sheet S is a so-called coated paper having a surface coated with a coating material, which is used for printing in many cases, it is not uncommon that a suction force increases 10 N or more owing to temperature or humidity of the use environment. Thus, when using such the sheet, in the case where the sheets cannot be sufficiently loosened by blowing air, there arise not only a problem in that the sheets are adhered to each other to be double fed, but also sometimes a problem in that ten or more sheets are fed together, thereby causing a jam.

SUMMARY OF THE INVENTION

The present invention has been made in view of the above-mentioned situation. It is therefore an object of the present invention to provide a sheet feeding apparatus and an image forming apparatus capable of reliably separating sheets without being affected by a use environment.

According to the present invention, a sheet feeding apparatus for feeding a sheet by blowing air on an edge portion of the sheet stacked on a sheet stacking portion to allow the sheet to float and sucking the floating sheet with a suction conveyer portion provided above the sheet stacking portion, includes: an air blowing portion, which blows air toward a leading edge portion on a downstream side in a sheet feeding direction of the sheet stacked on the sheet stacking portion; and a presser portion, which presses an upper surface of the sheet at both side edge portions in a width direction of the sheet stacked on the sheet stacking portion, wherein the presser portion presses the sheet at both side edge portions and the air blowing portion blows air on the leading edge portion of the sheet so that a central portion in the width direction perpendicular to the sheet feeding direction of the stacked sheet is blown up throughout an entire region in the sheet feeding direction.

Further features of the present invention will become apparent from the following description of exemplary embodiments with reference to the attached drawings.

DESCRIPTION OF THE EMBODIMENTS

Figure 1:
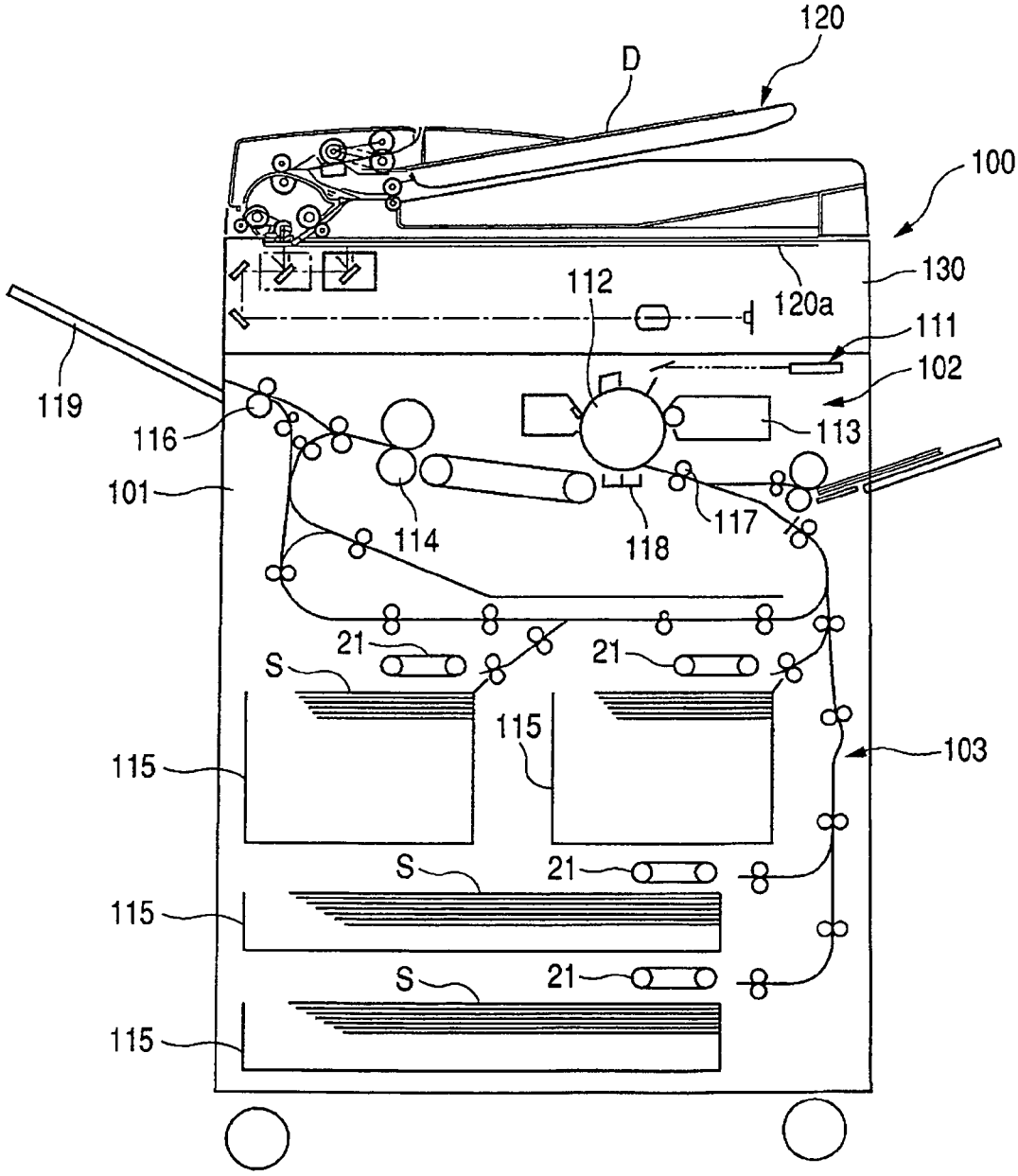
FIG. 1 is a schematic structural view showing a printer as an example of an image forming apparatus including a sheet feeding apparatus according to an embodiment of the present invention.

FIG. 1 is a schematic structural view showing a printer as an example of an image forming apparatus including a sheet feeding apparatus according to an embodiment of the present invention.

In FIG. 1, on an upper portion of a printer 100, there is provided an auto original feeder 120. Between a printer main body 101 and the auto original feeder 120, there is provided an image reading portion 130 for reading an original D fed from the auto original feeder 120 on a platen glass (original stacking table or original plate) 120*a*. Further, below the image reading portion 130, there is provided an image forming portion 102 and a sheet feeding apparatus 103 for feeding a sheet S toward an image forming portion 102.

The image forming portion 102 is provided with a photosensitive drum 112, a developing device 113, a laser scanner unit 111, and the like. The sheet feeding apparatus 103 includes a plurality of sheet containing portions 115 capable of being attached to and detached from the printer main body 101, for storing the sheets S, and sheet feeding means for feeding the sheets S contained in the sheet containing portions 115.

Next, an image forming operation of the printer 100 with such the structure will be described.

When an image reading signal is output from a control device (not shown) provided in the printer main body 101 to the image reading portion 130, an image is read out by the image reading portion 130. After that, a laser beam according to the image reading signal is applied from the laser scanner unit 111 to the photosensitive drum 112.

At this time, the photosensitive drum 112 is charged in advance, so, when the laser beam is applied, an electrostatic latent image is formed thereon. After that, by developing the electrostatic latent image by the developing device 113, a toner image is formed on the photosensitive drum 112.

Meanwhile, when a feeding signal is output from the control device to the sheet feeding apparatus 103, the sheet S is fed from the sheet containing portion 115. After that, the sheet S thus fed is sent to a transfer portion constituted of the photosensitive drum 112 and a transferring charger 118 by registration rollers 117 in synchronism with the toner image on the photosensitive drum 112.

The toner image is transferred onto the sheet S sent to the transfer portion, and the sheet is conveyed to a fixing portion 114. Further, after that, the fixing portion 114 heats and pressurizes the sheet S, whereby an unfixed transferred image on the sheet S is permanently fixed. The sheet S on which the image is fixed is delivered from the printer main body 101 to a delivery tray 119 by discharge rollers 116.

Figure 2:
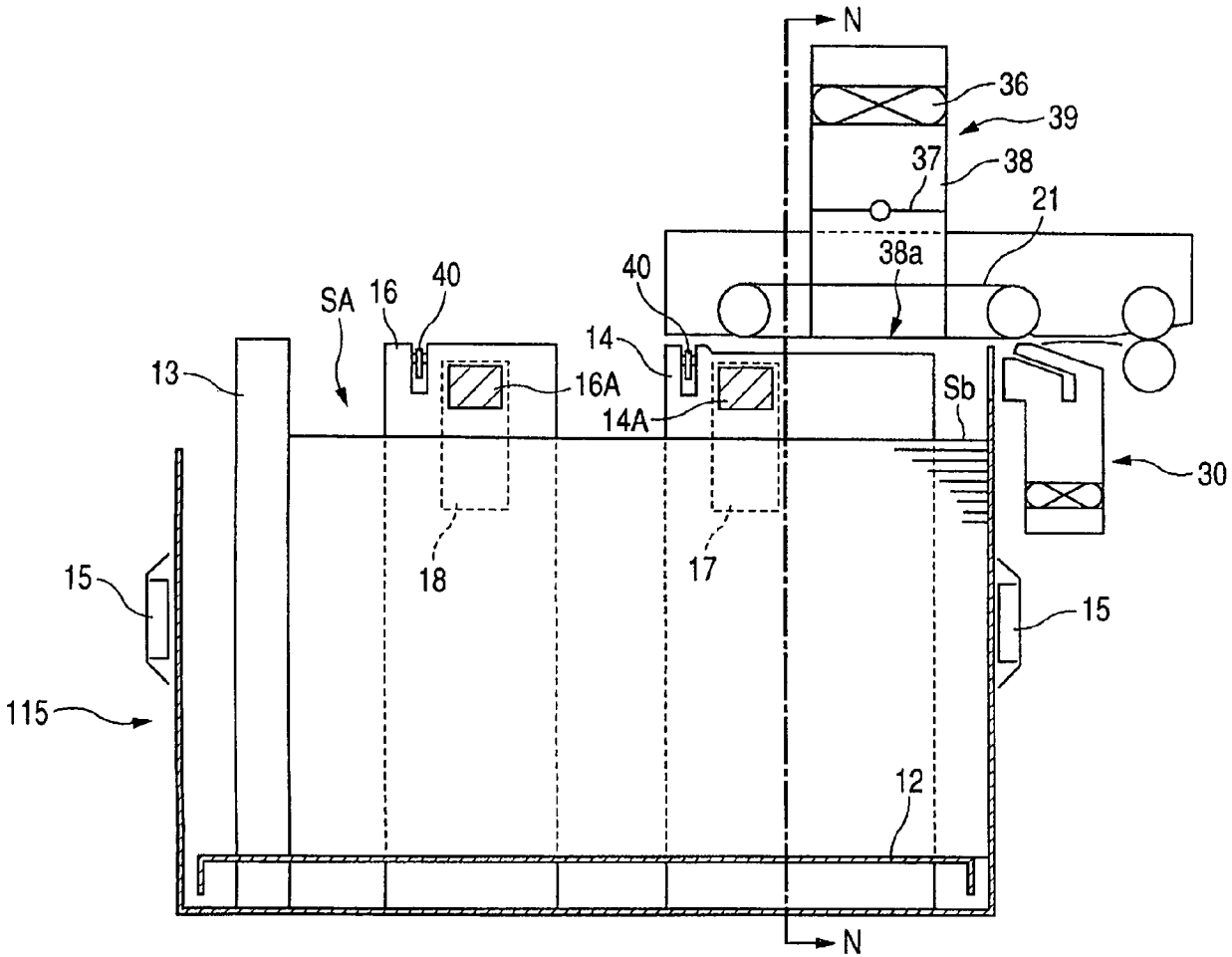
FIG. 2 is a schematic structural view showing the sheet feeding apparatus.
Figure 6:
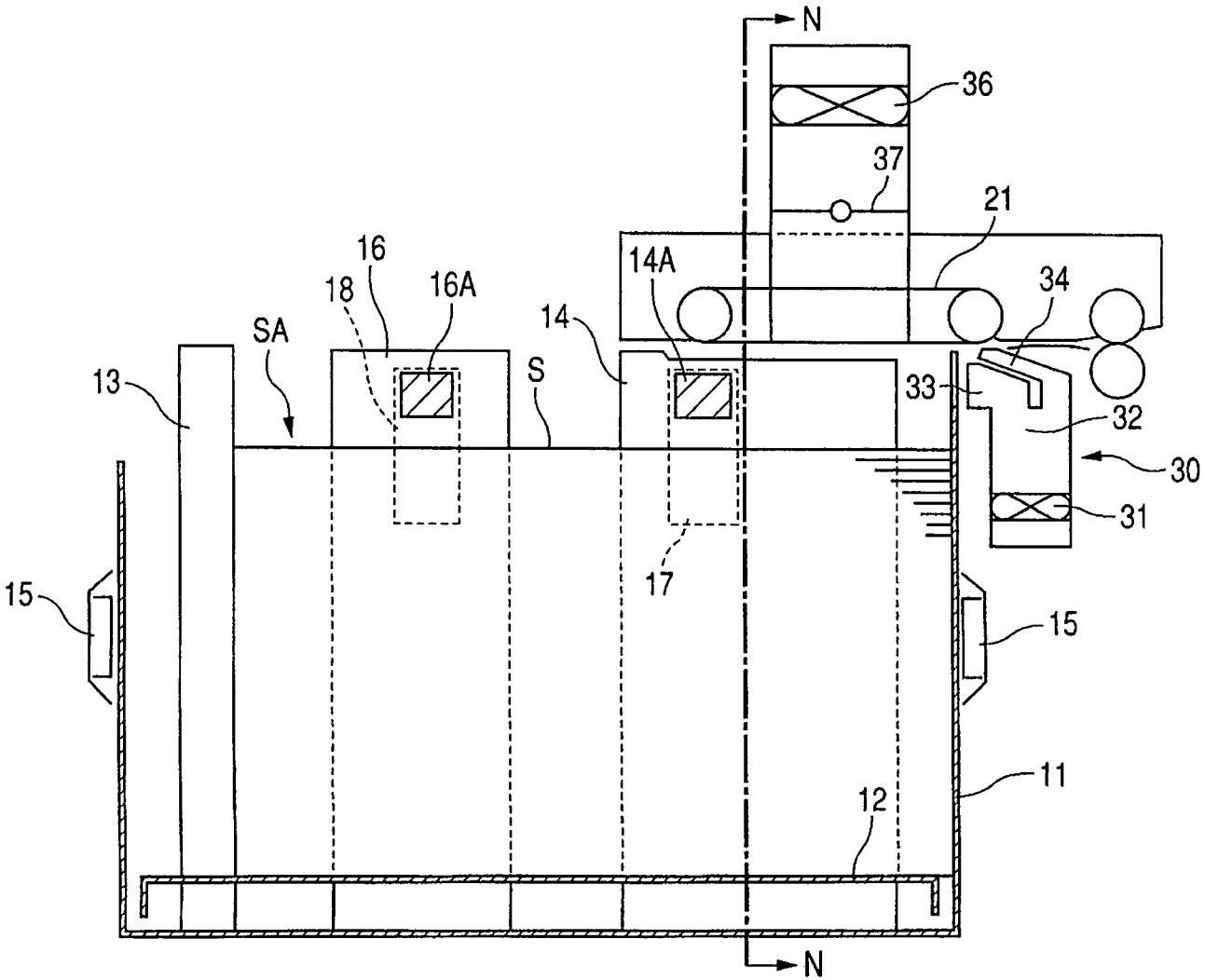
FIG. 6 is a schematic structural view of a conventional sheet feeding apparatus.
Figure 7:
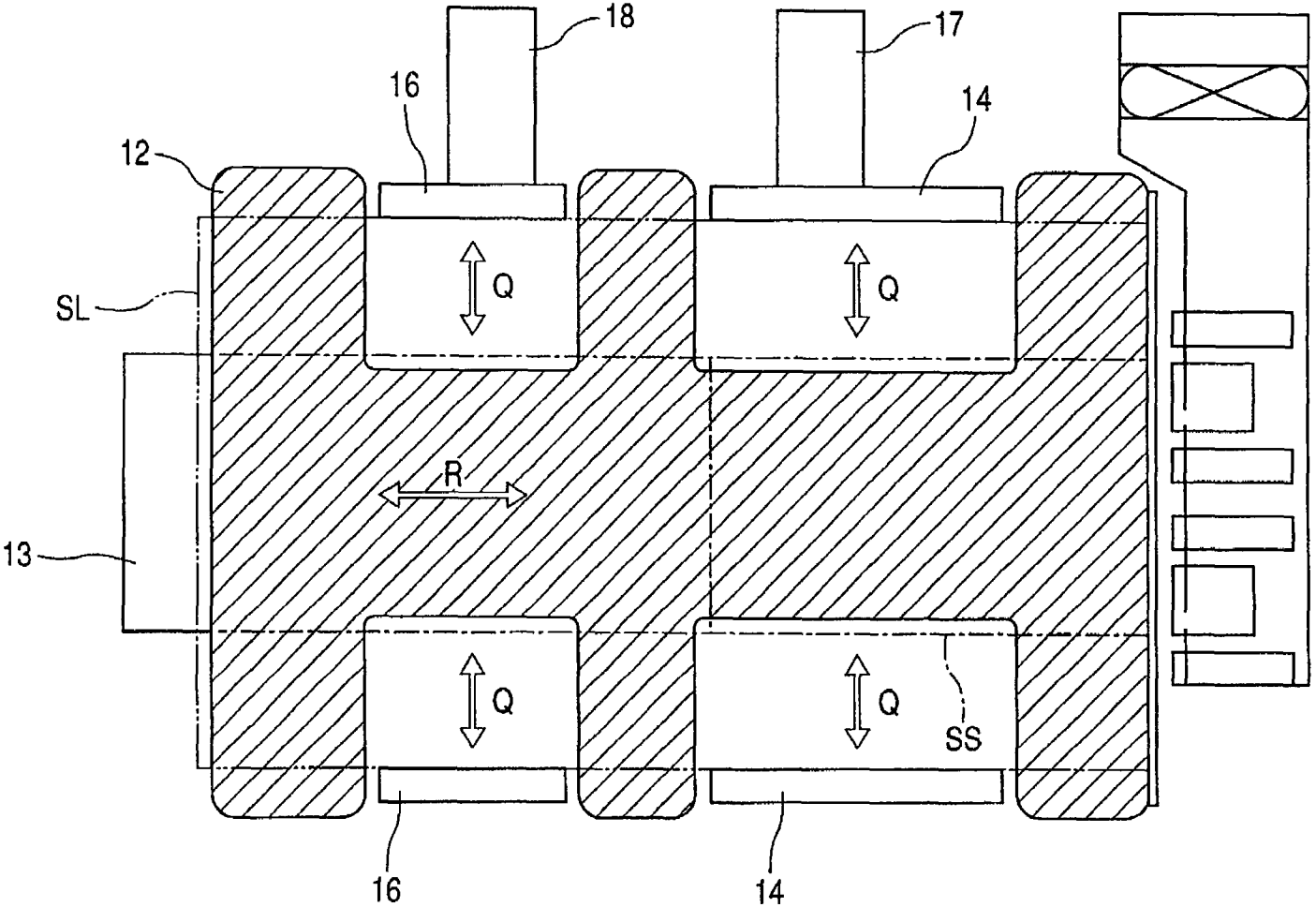
FIG. 7 is a view for explaining a trailing edge regulating plate, a side edge regulating plate, and a sheet tray provided to the conventional sheet feeding apparatus.
Figure 8:
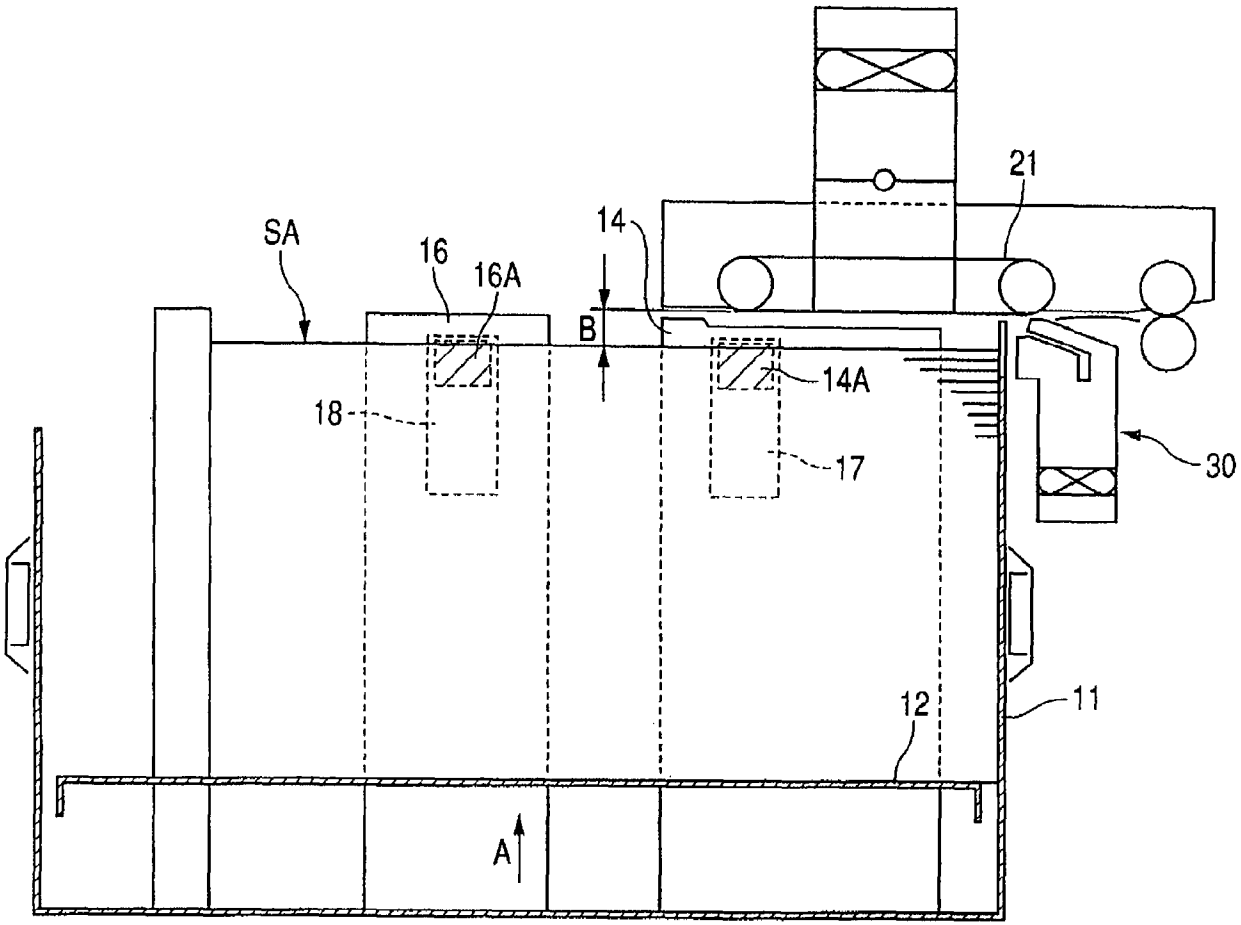
FIG. 8 is a first view for explaining a sheet feeding operation of the conventional sheet feeding apparatus.

FIG. 2 is a view showing a structure of the sheet feeding apparatus 103. Note that, in FIG. 2, the same reference symbols indicate the same or corresponding portions as those of FIG. 6 described above.

The sheet feeding apparatus 103 includes a suction conveyer portion 39, which sucks and feeds the sheets S stacked on a sheet tray 12 serving as a sheet stacking portion, and an air blowing portion 30, which blows air, in a direction opposite to a sheet feeding direction of the sheet S, on an edge surface on a downstream side in the sheet feeding direction.

The suction conveyer portion 39 includes a suction duct 38 having a suction opening portion 38*a* opening toward the sheet tray 12, and a suction fan 36 provided in the suction duct 38 and constituting a negative-pressure creating means for creating a negative pressure inside the suction duct 38. Further, there is provided a suction conveyer belt 21 serving as a sheet feeding means for feeding the sheets while sucking the sheets by the negative pressure created by the suction fan 36.

The air blowing portion 30 includes, similarly to the conventional apparatus, a separation fan 31, a separation duct 32, a loosening nozzle 33, and a separation nozzle 34. Air blown from the loosening nozzle 33 allows several sheets Sa on an upper portion of the sheet stack SA to float, and air blown from the separation nozzle 34 separates a subsequent sheet from the uppermost sheet Sb adhering onto the suction conveyer belt 21.

Further, the sheet feeding apparatus 103 includes side edge regulating plates 14 and 16 constituting side edge regulating members for regulating side edge positions of the sheet S stacked on the sheet tray 12 provided in the sheet containing portion 115. The side edge regulating plates 14 and 16 are provided with auxiliary separation fans 17 and 18, respectively, serving as auxiliary air blowing portions for blowing air on a side edge surface in a width direction of the sheet so as to be capable of supporting sheets of various sizes.

Figure 3:
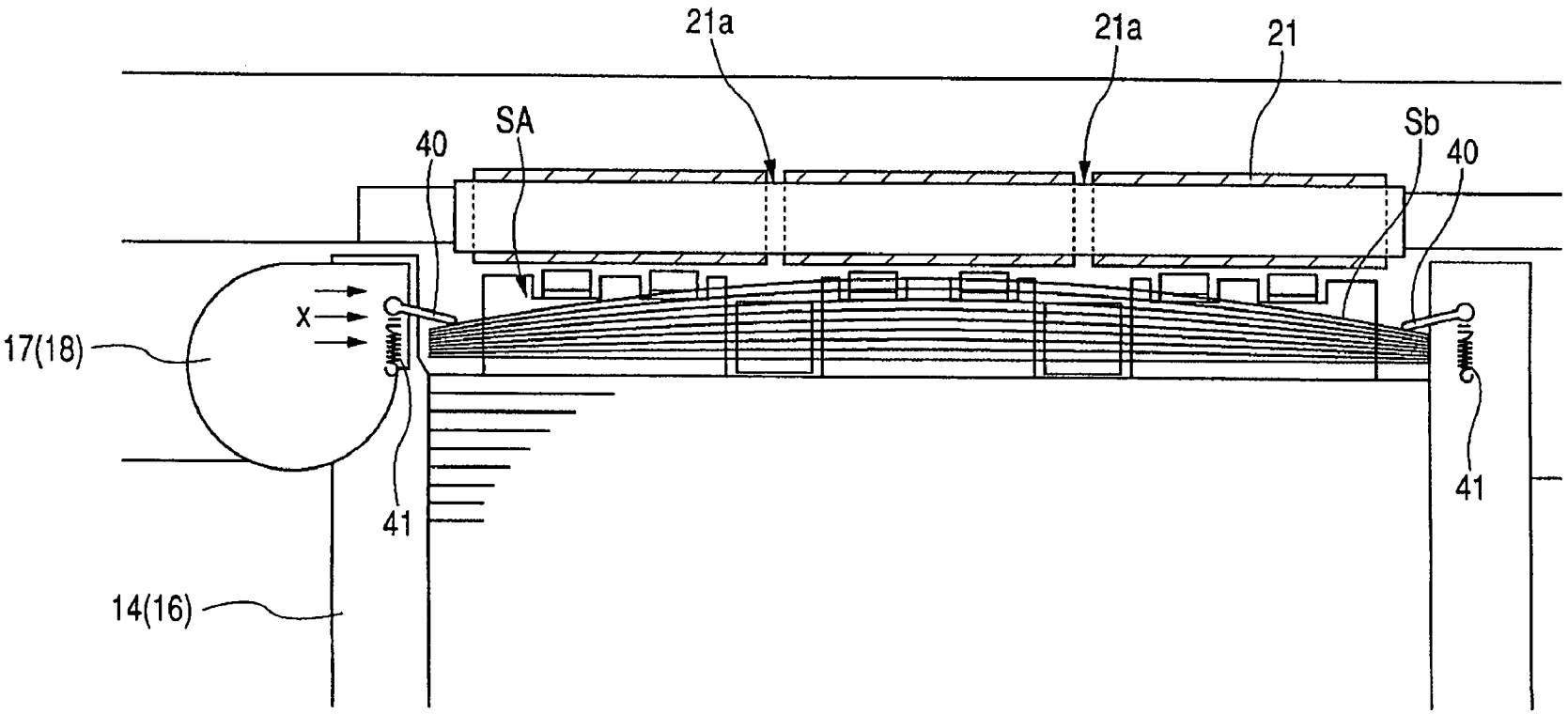
FIG. 3 is a view for explaining an operation of a float regulating member provided to the sheet feeding apparatus.

Further, in the vicinity of each of the auxiliary separation fans 17 and 18 of the side edge regulating plates 14 and 16 (i.e., openings 14A and 16A of the auxiliary separation fans 17 and 18), respectively, there is provided a presser portion which characterizes the present invention. The presser portion includes, as shown in FIG. 3, a float regulating member 40 mounted so as to be vertically rotatable and a biasing member 41, which biases the float regulating member 40. The biasing members 41 allow the float regulating members 40 to abut on an upper surface of the sheet Sb at both side edge portions of the sheet Sb in a state where the uppermost sheet Sb of the sheet stack SA on the sheet tray 12 is lifted to a predetermined position. Note that, a biasing force due to the biasing member 41 is set such that a minimal resistance exerts on the sheet so as to regulate the both side edge portions of the sheet to float without inhibiting suction of the uppermost sheet to the suction conveyer belt 21. That is, a biasing force of which the biasing member 41 abuts on the upper surface of the sheet is weaker than a suction force by which the suction conveyer belt 21 sucks the sheet.

When the upper surface of the sheet stack SA is suppressed at the both side edge portions with the float regulating member 40 and air is blown toward the leading edge portion of the sheet stack SA by the blowing portion 30, a central portion in the width direction of the sheet S as shown in FIG. 3 is blown up to assume a curved shape which is convex upward. In FIG. 3, the suction conveyer belt 21 is provided with sheet suction holes 21*a* formed therein.

Figure 4:
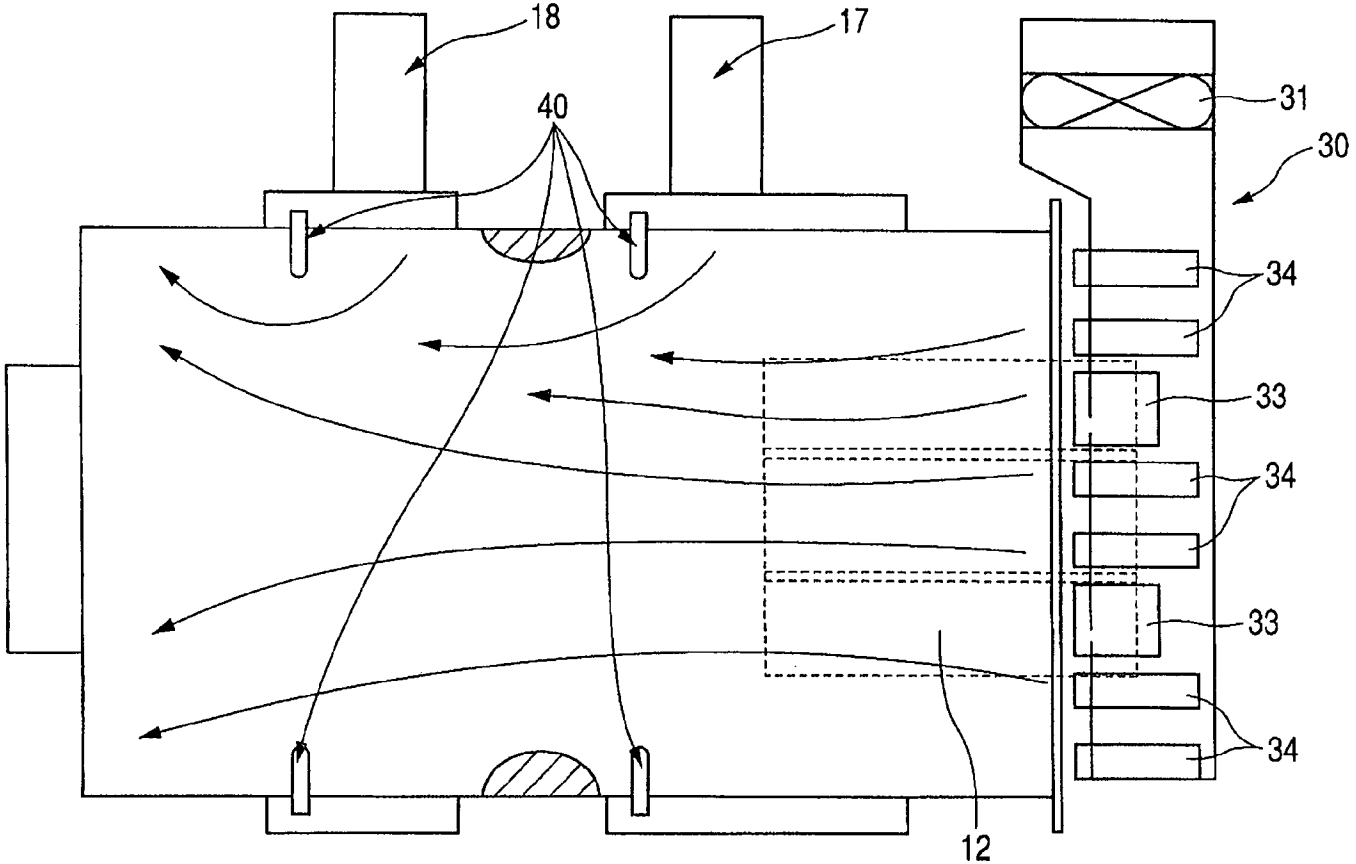
FIG. 4 is a view showing flows of air in the sheet feeding apparatus.

FIG. 4 is a perspective view as viewed from above. FIG. 4 shows flows of air at this time. As is apparent from FIG. 4, with provision of the float regulating member 40, unlike the flows of air shown in FIG. 13 described above, leakage of air in circular regions shown in FIG. 13 is prevented.

Figure 5:
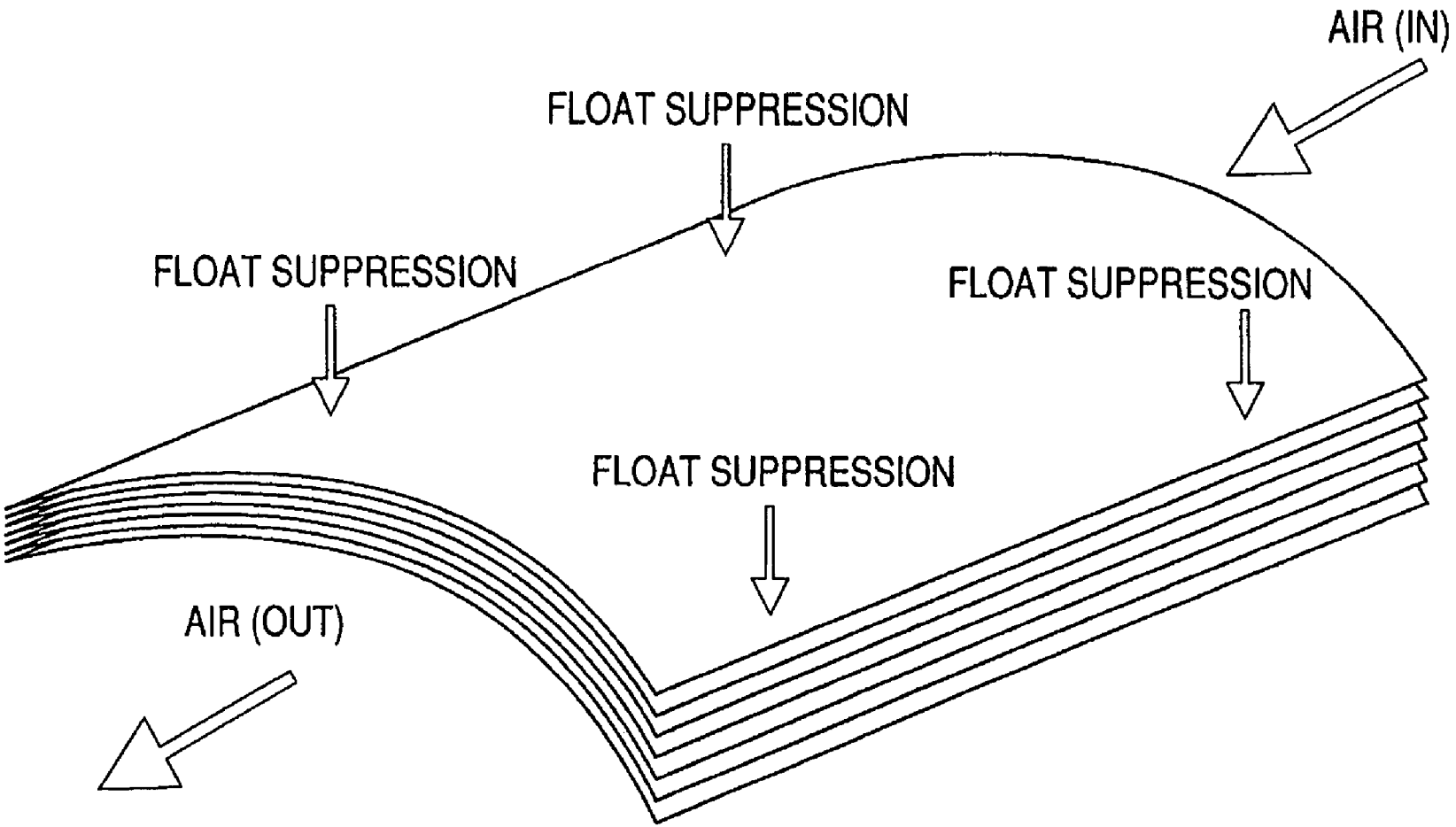
FIG. 5 is a perspective view showing a state of sheets when the sheets are fed by the sheet feeding apparatus.
Figure 13:
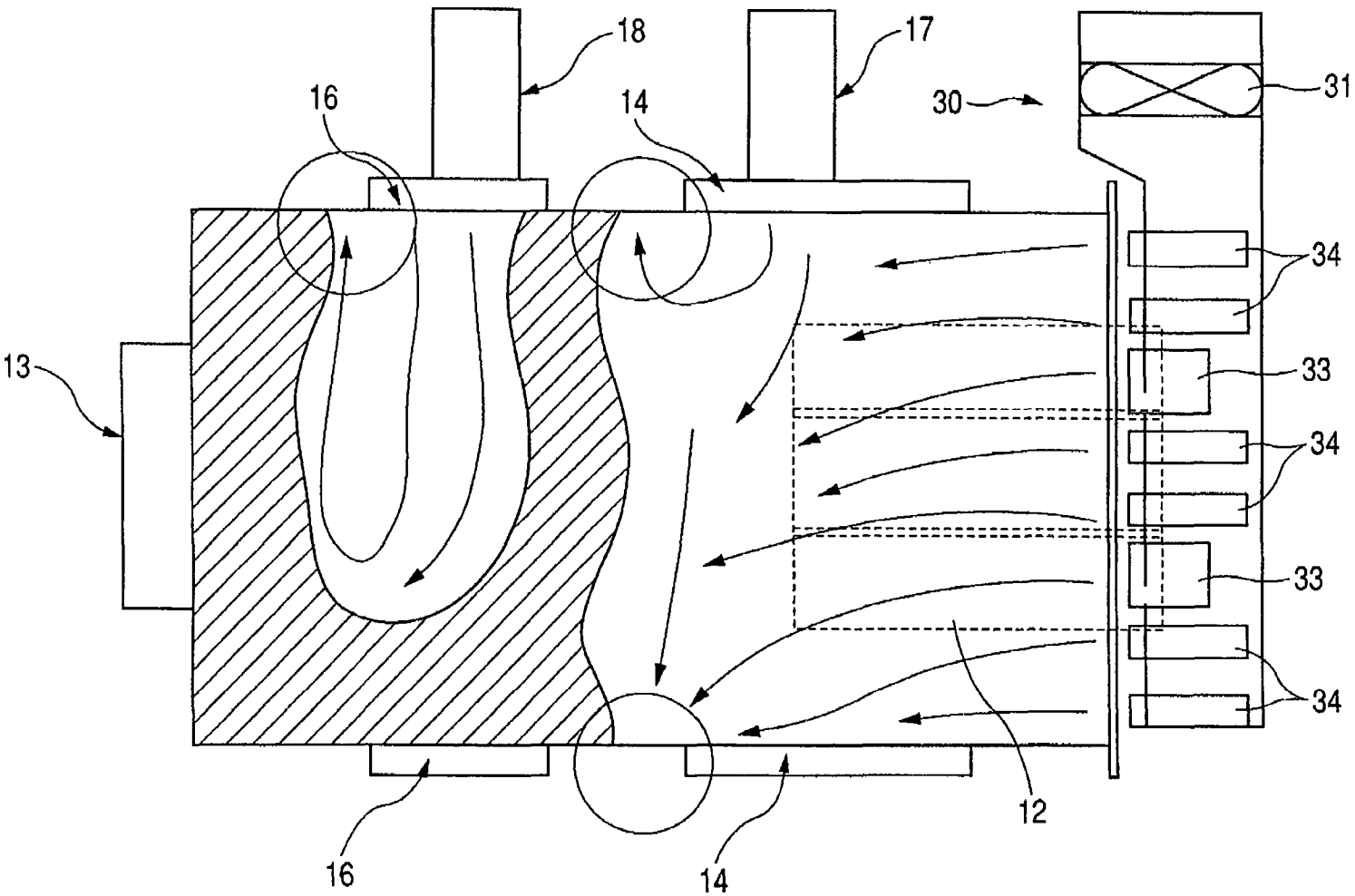
FIG. 13 is a view showing flows of air in the conventional sheet feeding apparatus.

As a result, the air flows between the sheets S to the upstream side of the sheet feeding direction and into a suction region shown as the hatched region in FIG. 13 to gradually eliminate the adhesion of the sheets S. Consequently, as shown in FIG. 5, a floating state in which each of the sheets assumes a shape like that of an up-side-down gutter is achieved. In the floating state, the central portions in the width direction of the sheets S are convex upward throughout an entire region of the sheets S in the sheet feeding direction.

With such the construction, in hatched portions of FIG. 4 between the side edge regulating plates 14 and the side edge regulating plates 16, there are sometimes generated regions where the sheets adhere to each other, but those are the only regions where the sheets adhere to each other, so it does not pose no problem at all regarding the separation of the sheets.

The float regulating members 40 are provided in two positions on each of the upstream sides of the auxiliary separation fans 17 and 18. However, if the suppressing force of the float regulating members 40 is weak, it is occasionally impossible to achieve the floating state in which each of the sheets assumes a shape like that of the up-side-down gutter. In such the case, it suffices that additional float regulating members are provided on the downstream side of the auxiliary separation fan 18 (further upstream side of the auxiliary separation fan 17).

As described above, the float regulating members 40 suppress the both side edge portions of the sheets, the air blown by the air blowing portion 30 allows the central portions in the width direction of the sheets to float throughout the entire region of the sheets in the sheet feeding direction, thereby making it possible to eliminate the adherence of the sheets. As a result, without being affected by the use environment, the sheets can be reliably separated. Consequently, it is possible to provide a highly reliable sheet feeding apparatus in which no double feed or jam is caused. Further, as described in this embodiment, the float regulating members 40 are provided in the vicinities of the auxiliary separation fans 17 and 18 where the adhesion between the sheets tends to occur, thereby making it possible to more effectively prevent the leakage of air and enhance reliability.

A basic feeding operation of the sheet feeding apparatus constructed as described above is the same as a conventional operation described in a section of the related background art, and differs from the conventional operation in that the sheet stack can be loosened efficiently. Such the effective operation will be briefly described with reference to FIGS. 9 to 11 employed in the description of the related background art.

Figure 9:
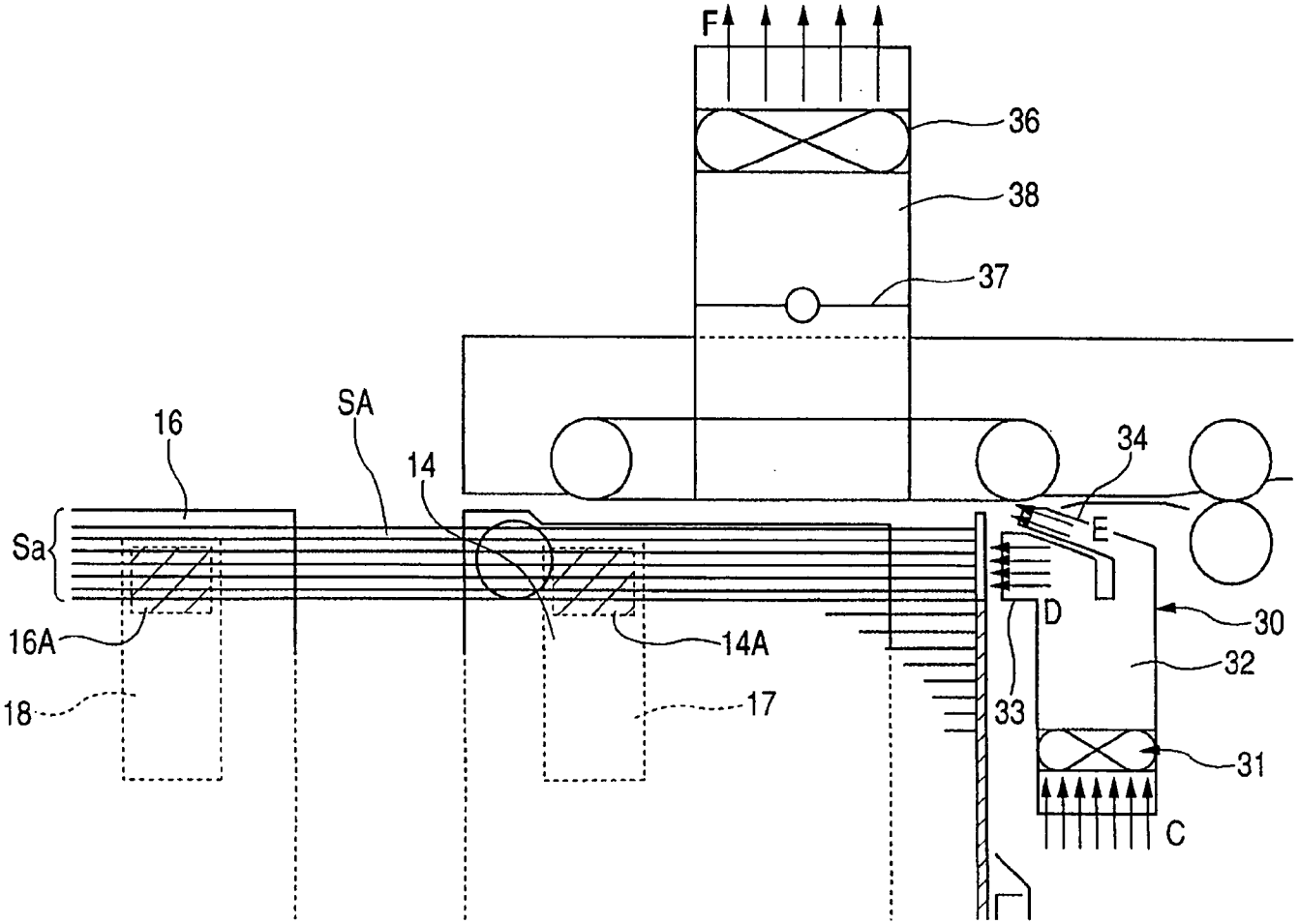
FIG. 9 is a second view for explaining the sheet feeding operation of the conventional sheet feeding apparatus.

As shown in FIG. 9, in a state of waiting for the sheet feeding signal, when the feeding signal is input, the separation fan 31 operates to suck air in the direction indicated by the arrows C. The air sucked by the separation fan 31 is allowed to blow toward the leading edge portion of the sheet stack SA from the loosening nozzle 33 and the separation nozzle 34 through the separation duct 32 in the directions indicated by the arrows D and E, respectively. At this moment, the both edge portions of the sheets are suppressed by the float regulating members 40, so the central portion in the width direction of the sheets are blown up throughout the entire region of the sheet in the sheet feeding direction. As a result, the adhesion of the several sheets on the upper portion of the sheet stack SA are eliminated, thereby the several upper sheets Sa reliably loosened by air introduced between the sheets Sa are allowed to float.

Figure 10:
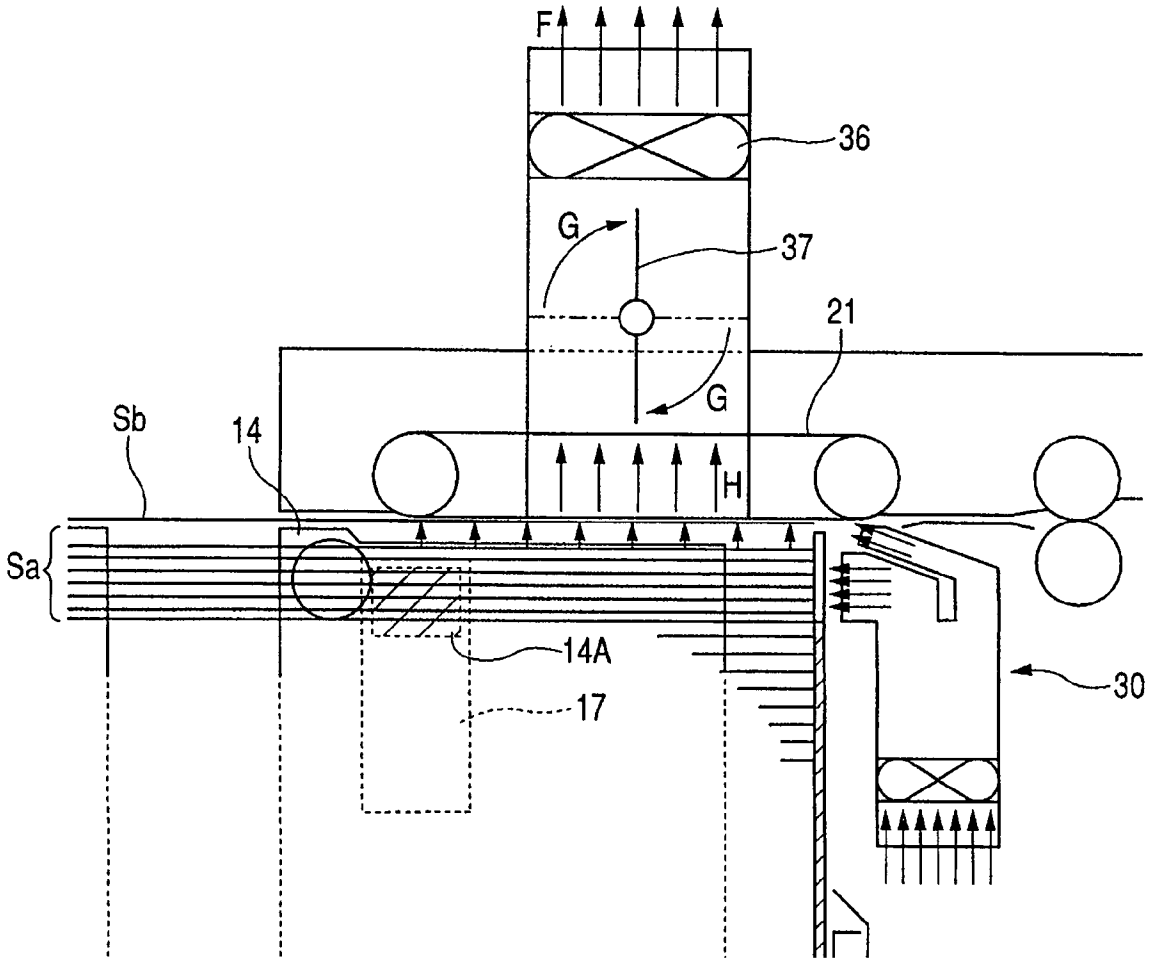
FIG. 10 is a third view for explaining the sheet feeding operation of the conventional sheet feeding apparatus.

In such the state, as shown in FIG. 10, the suction shutter 37 of the suction conveyer portion 39 is rotated in the direction indicated by the arrows G. As a result, the suction fan 36 generates the suction force in the direction indicated by the arrows H from the holes 21*a* formed in the suction conveyer belt 21, thus the uppermost sheet Sb of the several upper sheets Sa which are allowed to float is allowed to suck onto the suction conveyer belt 21.

Figure 11:
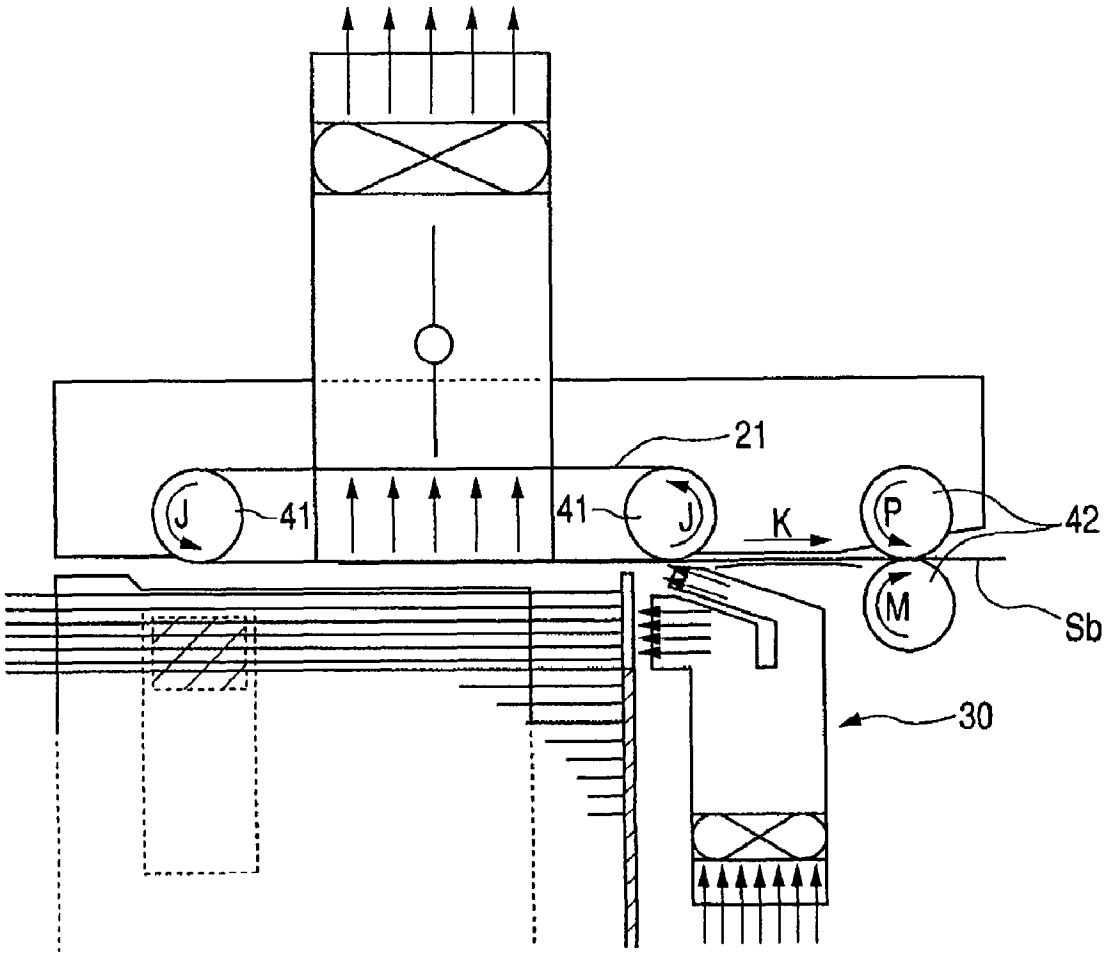
FIG. 11 is a fourth view for explaining the sheet feeding operation of the conventional sheet feeding apparatus.
Figure 12:
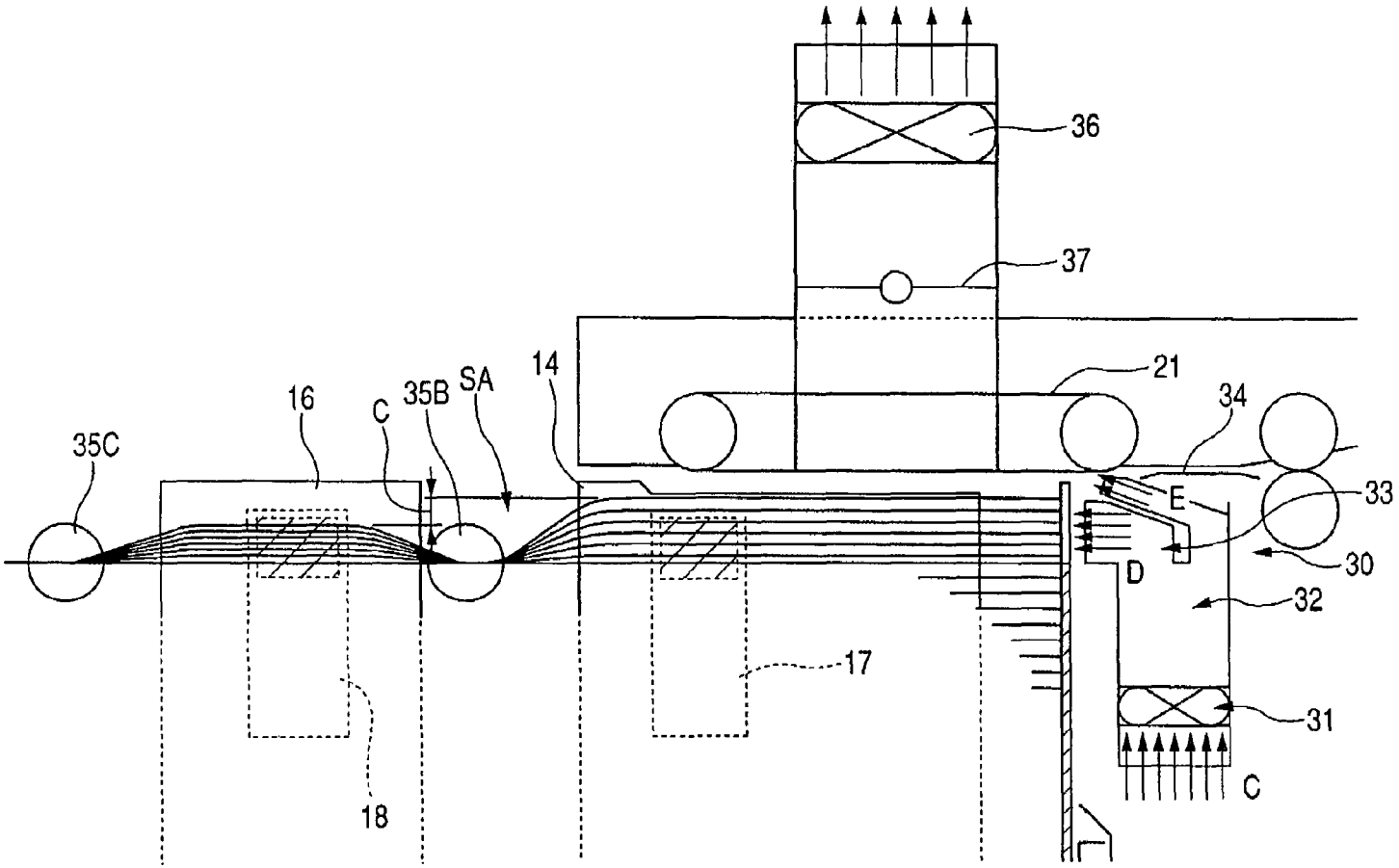
FIG. 12 is a view for explaining a problem with the conventional sheet feeding apparatus.

Then, as shown in FIG. 11, the belt drive rollers 41 are rotated in the direction indicated by the arrows J, thereby feeding the sheet Sb allowed to suck onto the suction conveyer belt 21 in a direction indicated by the arrow K. After that, the sheet Sb allowed to suck is sent by the drawing roller pair 42 rotating in the directions indicated by the arrows M and P to the conveying path on the down stream side thereof to be supplied to the image forming portion.

Note that, in the description provided above, the auxiliary separation fans 17 and 18 are provided on the side edge regulating plates 14 and 16 on one side as shown in FIG. 4, respectively. However, the auxiliary separation fans 17 and 18 may be provided on the side edge regulating plates 14 and 16 on the other side, respectively, and may also be provided on the side edge regulating plates 14 and 16 on both sides.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit from Japanese Patent Application No. 2006-044502 filed on Feb. 21, 2006, which is hereby incorporated by reference herein in its entirety.

What is claimed is:

1. A sheet feeding apparatus, which blows air on an edge portion of sheets stacked on a sheet stacking portion to allow the sheets to float and sucks a floating sheet with a suction conveyer portion provided above the sheet stacking portion, to feed the sheet, the sheet feeding apparatus comprising:

an air blowing portion, which blows air toward a leading edge portion on a downstream side in a sheet feeding direction of the sheets stacked on the sheet stacking portion;

an auxiliary air blowing portion, which blows air on a side edge portion in a width direction of the sheets stacked on the sheet stacking portion;

a pair of side edge regulating members disposed in the width direction of the stacked sheets, which regulate a position of the side edge portion of the sheets stacked on the sheet stacking portion; and a plurality of presser portions, which are provided on the side edge regulating members and press an upper surface of the sheet at side edge portions in the width direction of the sheets stacked on the sheet stacking portion, wherein the presser portions are rotatably provided on the side edge regulating members and are biased in a direction in which tips of the presser portions abut on the upper surface of the sheets by biasing members, and the presser portions press the sheets at side edge portions, and the air blowing portion and the auxiliary air blowing portion blow the air on the leading edge portion and the side edge portion of the sheets so that a central portion in the width direction perpendicular to the sheet feeding direction of the stacked sheets is blown up.

2. A sheet feeding apparatus according to claim 1, wherein the side edge regulating members are provided with the auxiliary air blowing portion and the presser portions.

3. A sheet feeding apparatus according to claim 1, wherein a biasing force of the biasing members is weaker than a suction force of the suction conveyer portion.

4. A sheet feeding apparatus according to claim 3, wherein the presser portions have float regulating members which are rotatably provided and opposed to the side edge portions of the upper surface of the sheets, and biasing members which bias the float regulating members toward the upper surface of the sheets.

5. A sheet feeding apparatus according to claim 1, wherein the suction conveyer portion comprises:

a suction duct having a suction opening portion provided on a side of the sheet stacking portion of the suction duct;

negative-pressure creating means provided in the suction duct, for creating a negative pressure in the suction duct; and a suction conveyer belt, which has a plurality of suction holes, and conveys the sheet while sucking the sheet through the plurality of suction holes by the negative pressure created by the negative-pressure creating means.

6. An image forming apparatus, including: a sheet feeding apparatus, which blows air on an edge portion of sheets stacked on a sheet stacking portion to allow the sheets to float and sucks a floating sheet with a suction conveyer portion provided above the sheet stacking portion, to feed the sheet; and an image forming portion, which forms an image on the sheet fed by the sheet feeding apparatus, the image forming apparatus comprising:

an air blowing portion, which blows the air toward a leading edge portion on a downstream side in a sheet feeding direction of the sheets stacked on the sheet stacking portion;

an auxiliary air blowing portion, which blows air on a side edge portion in a width direction of the sheet stacked on the sheet stacking portion;

a pair of side edge regulating members disposed in the width direction of the stacked sheets, which regulate a position of the side edge portion of the sheets stacked on the sheet stacking portion; and a plurality of presser portions, which are provided on the side edge regulating members and press an upper surface of the sheet at side edge portions in the width direction of the sheets stacked on the sheet stacking portion, wherein the presser portions are rotatably provided on the side edge regulating members and are biased in a direction in which tips of the presser portions abut on the upper surface of the sheets by biasing members, and the presser portions press the sheets at side edge portions, and the air blowing portion and the auxiliary air blowing portion blow the air on the leading edge portion and the side edge portion of the sheets so that a central portion in the width direction perpendicular to the sheet feeding direction of the stacked sheets are blown up.

7. An image forming apparatus according to claim 6, wherein the side edge regulating members are provided with the auxiliary air blowing portion and the presser portions.

8. An image forming apparatus according to claim 6, wherein a biasing force of the biasing members is weaker than a suction force of the suction conveyer portion.

9. An image forming apparatus according to claim 8, wherein the presser portions have float regulating members which are rotatably provided and opposed to side edge portions of the upper surface of the sheets, and biasing members which bias the float regulating members toward the upper surface of the sheets.

10. An image forming apparatus according to claim 6, wherein the suction conveyer portion comprises:

a suction duct having a suction opening portion provided on a side of the sheet stacking portion of the suction duct;

negative-pressure creating means provided in the suction duct, for creating a negative pressure in the suction duct; and a suction conveyer belt, which has a plurality of suction holes, and conveys the sheet while sucking the sheet through the plurality of suction holes by the negative pressure created by the negative-pressure creating means.

* * * * *